US011434810B2

(12) United States Patent
Smith et al.

(10) Patent No.: US 11,434,810 B2
(45) Date of Patent: Sep. 6, 2022

(54) VEHICLE THERMAL MANAGEMENT SYSTEM INCLUDING MECHANICALLY DRIVEN PUMP, ROTARY VALVE(S), BYPASS LINE ALLOWING ENGINE OUTLET COOLANT TO BYPASS HEAT EXCHANGER(S), OR COMBINATIONS THEREOF

(71) Applicant: GM GLOBAL TECHNOLOGY OPERATIONS LLC, Detroit, MI (US)

(72) Inventors: Michael A. Smith, Clarkston, MI (US); Eugene V. Gonze, Pickney, MI (US); Daniel L. Molnar, Brighton, MI (US); Sergio Quelhas, Ann Arbor, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/167,676

(22) Filed: Feb. 4, 2021

(65) Prior Publication Data

US 2022/0243642 A1 Aug. 4, 2022

(51) Int. Cl.
*F01P 7/16* (2006.01)
*F01P 7/14* (2006.01)

(52) U.S. Cl.
CPC ..... *F01P 7/165* (2013.01); *F01P 7/167* (2013.01); *F01P 2007/146* (2013.01); *F01P 2025/50* (2013.01); *F01P 2060/045* (2013.01); *F01P 2060/08* (2013.01)

(58) Field of Classification Search
CPC ..... F01P 2007/146; F01P 7/167; F01P 3/00; F01P 7/14; F01P 2025/40; F01P 2007/143; Y10T 137/86863; Y10T 137/86823; B60H 1/00885
USPC ..... 123/41.08, 41.01, 41.57
See application file for complete search history.

(56) References Cited

U.S. PATENT DOCUMENTS 9,188,051 B1 * 11/2015 Zahdeh ..... F01N 13/1866
2005/0000473 A1 * 1/2005 Ap ..... F01P 7/165 123/41.1
2007/0252015 A1 * 11/2007 Norris ..... F16K 11/0876 236/93 R (Continued)

FOREIGN PATENT DOCUMENTS

CN 103775221 A * 5/2014 ..... B60H 1/00385
DE 10335298 A1 * 6/2004 ..... F01P 7/164

(Continued)

OTHER PUBLICATIONS

U.S. Appl. No. 16/531,754, filed Aug. 5, 2019, Smith et al.
U.S. Appl. No. 16/570,579, filed Sep. 13, 2019, Smith et al.
U.S. Appl. No. 16/736,177, filed Jan. 7, 2020, Smith et al.

*Primary Examiner* — George C Jin
*Assistant Examiner* — Teuta B Holbrook

(57) ABSTRACT

A system includes a coolant pump and a first rotary valve. The coolant pump is configured to be mechanically driven by an engine and to send coolant to an inlet of the engine. The first rotary valve is configured to receive coolant from an outlet of the engine and to send coolant to a first radiator and a heater core. The first rotary valve is adjustable to a zero flow position to prevent coolant flow to the first radiator and the heater core and thereby increase a rate at which the engine warms coolant flowing therethrough.

16 Claims, 6 Drawing Sheets

(56) References Cited

U.S. PATENT DOCUMENTS

| | | | | |
|---|---|---|---|---|
| 2015/0101693 | A1* | 4/2015 | Enomoto | F16K 31/535 137/597 |
| 2018/0272840 | A1* | 9/2018 | Onishi | B60H 1/00885 |
| 2018/0371982 | A1* | 12/2018 | Bilancia | F02M 26/28 |
| 2019/0234292 | A1* | 8/2019 | Gonze | F01P 5/10 |
| 2020/0309017 | A1* | 10/2020 | Kardos | F01P 7/165 |
| 2020/0386328 | A1 | 12/2020 | Smith et al. | |

FOREIGN PATENT DOCUMENTS

| | | | | | |
|---|---|---|---|---|---|
| DE | 102018003322 | A1 | * | 11/2018 | F01K 23/065 |
| DE | 112019004542 | T5 | * | 5/2021 | F01K 13/02 |
| GB | 2519167 | A | * | 4/2015 | F01N 3/046 |
| JP | 2020180574 | A | * | 11/2020 | |
| SE | 1551380 | A1 | * | 5/2017 | |

* cited by examiner

VEHICLE THERMAL MANAGEMENT SYSTEM INCLUDING MECHANICALLY DRIVEN PUMP, ROTARY VALVE(S), BYPASS LINE ALLOWING ENGINE OUTLET COOLANT TO BYPASS HEAT EXCHANGER(S), OR COMBINATIONS THEREOF

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to a vehicle thermal management system including a mechanically driven pump, one or more rotary valves, a bypass line allowing engine outlet coolant to bypass one or more heat exchangers, or combinations thereof.

A vehicle thermal management system typically includes a coolant pump, a radiator, a condenser, a heater core, an engine oil heater, a transmission oil heater, and valves. The coolant pump circulates coolant through an engine, the radiator, the heater core, the engine oil heater, and the transmission oil heater. The radiator cools coolant flowing therethrough to prevent the engine from overheating. The radiator typically includes a fan that blows ambient air through the radiator. The heater core heats air from a vehicle cabin by transfer heat from coolant flowing through the heater core to cabin air flowing through the heater core. The engine oil heater heats engine oil that is circulated through the engine. The transmission oil heater heats transmission oil that is circulated through a transmission.

The condenser condenses gaseous refrigerant flowing coils in the condenser into liquid refrigerant by cooling the refrigerant. The fan of the main radiator blows air past the coils in the condenser to cool the refrigerant. The cooled refrigerant is used to cool air within the vehicle cabin. The valves are used to control coolant flow to the radiator, the heater core, the engine oil heater, and the transmission oil heater.

SUMMARY

A first example of a system according to the present disclosure includes a coolant pump and a first rotary valve. The coolant pump is configured to be mechanically driven by an engine and to send coolant to an inlet of the engine. The first rotary valve is configured to receive coolant from an outlet of the engine and to send coolant to a first radiator and a heater core. The first rotary valve is adjustable to a zero flow position to prevent coolant flow to the first radiator and the heater core and thereby increase a rate at which the engine warms coolant flowing therethrough.

In one aspect, the first rotary valve is adjustable to a plurality of nonzero flow positions to allow coolant to flow to each of the first radiator and the heater core at a plurality of nonzero flow rates that are different than one another.

In one aspect, the first rotary valve is operable to regulate a rate of coolant flow to the first radiator independent of regulating a rate of coolant flow to the heater core, and to regulate the rate of coolant flow to the heater core independent of regulating the rate of coolant flow to the first radiator.

In one aspect, the system further includes a second rotary valve configured to receive coolant from the first rotary valve and to send coolant to an engine oil heater and a transmission oil heater. The second rotary valve is adjustable to a zero flow position to prevent coolant flow to the engine oil heater and the transmission oil heater.

In one aspect, the system further includes an engine inlet line extending from the coolant pump to the inlet of the engine, and the second rotary valve is configured to receive coolant from the engine inlet line.

In one aspect, the system further includes a second radiator configured to receive coolant from the engine inlet line, send coolant to the second rotary valve, and cool coolant flowing through the second radiator.

In one aspect, the system further includes a rotary valve control module configured to adjust the first and second rotary valves to their zero flow positions when a temperature of coolant flowing through the engine is less than a first target temperature.

In one aspect, the rotary valve control module is configured to adjust the second rotary valve to send coolant to the transmission oil heater when the engine coolant temperature is greater than or equal to the first target temperature and a temperature of oil flowing through the transmission oil heater is less than a second target temperature.

In one aspect, the rotary valve control module is configured to adjust the second rotary valve to send coolant to the engine oil heater when the engine coolant temperature is greater than or equal to the first target temperature and a temperature of oil flowing through the engine oil heater is less than a second target temperature.

In one aspect, when the engine coolant temperature is greater than or equal to the first target temperature and a temperature of a cylinder wall of the engine is greater than a second target temperature, the rotary valve control module is configured to adjust the first rotary valve to send coolant from the outlet of the engine to the first radiator and the heater core, and to adjust the second rotary valve to send coolant from the engine inlet line to the engine oil heater and the transmission oil heater.

In one aspect, the system further includes a bypass line configured to receive coolant from the first rotary valve and to allow coolant flowing therethrough to bypass the first radiator and the heater core, and the first rotary valve is configured to send coolant to the inlet of the engine through the bypass line.

In one aspect, the first rotary valve is adjustable to a plurality of nonzero flow positions to allow coolant to flow through the bypass line at a plurality of nonzero flow rates.

In one aspect, the rotary valve control module is configured to adjust the first rotary valve to send coolant to the inlet of the engine through the bypass line while sending coolant to the first radiator and the heater core when the engine coolant temperature is greater than or equal to the first target temperature, the cylinder wall temperature is greater than the second target temperature, and a speed of the engine is greater than a predetermined speed.

In one aspect, the rotary valve control module is configured to adjust the first rotary valve to prevent coolant flow to the engine through the bypass line when the engine coolant temperature is greater than or equal to the first target temperature, the cylinder wall temperature is greater than the second target temperature, and the engine speed is less than or equal to the predetermined speed.

In one aspect, when the engine coolant temperature is greater than or equal to the first target temperature and the cylinder wall temperature is less than or equal to the second target temperature, the rotary valve control module is configured to adjust the first rotary valve to send coolant from the outlet of the engine to the first radiator and the heater core and from the outlet of the engine to the inlet of the engine through the bypass line, and to adjust the second rotary valve to its zero flow position to prevent coolant flow to the engine oil heater and the transmission oil heater.

A second example of a system according to the present disclosure includes a coolant pump, a multi-position valve, and a bypass line. The coolant pump is configured to send coolant to an inlet of an engine. The multi-position valve is configured to receive coolant from an outlet of the engine and to send coolant to at least one heat exchanger. The multi-position valve is adjustable to a zero flow position to prevent coolant flow to the at least one heat exchanger. The bypass line is configured to receive coolant from the multi-position valve and to allow coolant flowing therethrough to bypass the at least one heat exchanger. The multi-position valve is configured send coolant to the engine through the bypass line.

In one aspect, the system further includes an engine inlet line extending from an outlet of the at least one heat exchanger to an inlet of the coolant pump, and the bypass line extends from the multi-position valve to the engine inlet line.

In one aspect, the at least one heat exchanger includes a radiator, and the engine inlet line extends from the outlet of the radiator to the inlet of the coolant pump.

A third example of a system according to the present disclosure includes an engine, a coolant pump, a first rotary valve, and a second rotary valve. The coolant pump is mechanically driven by the engine and is configured to send coolant to an inlet of the engine. The coolant pump is always engaged with the engine when the coolant pump is assembled to the engine. The first rotary valve is configured to receive coolant from an outlet of the engine and to send coolant to a radiator and a heater core. The first rotary valve is adjustable to a zero flow position to prevent coolant flow to the radiator and the heater core. The second rotary valve is configured to receive coolant from the first rotary valve and to send coolant to an engine oil heater and a transmission oil heater. The second rotary valve is adjustable to a zero flow position to prevent coolant flow to the engine oil heater and the transmission oil heater.

In one aspect, the first rotary valve is adjustable to a plurality of nonzero flow positions to allow coolant to flow to each of the radiator and the heater core at a first plurality of nonzero flow rates that are different than one another, and the second rotary valve is adjustable to a plurality of nonzero flow positions to allow coolant to flow to each of the engine oil heater and the transmission oil heater at a second plurality of nonzero flow rates that are different than one another.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Some vehicle thermal management systems have an electric coolant pump. When the cooling demand of the engine is high, such as when the engine speed is high and/or when a vehicle is towing a trailer, the electric coolant pump has high power demand. The electrical systems of some vehicles may not be configured to supply enough power to the electric coolant pump during periods of high cooling demand. Thus, the electrical systems of these vehicles may need to be redesigned for an electric coolant pump, which may increase the cost of these vehicles.

Other vehicle thermal management systems have a mechanical coolant pump (i.e., a coolant pump that is mechanically driven by the engine). The mechanical coolant pump is typically sized based on the highest possible cooling demand of the vehicle. Thus, the mechanical coolant pump may be oversized for normal or low cooling demands, which increases the cost of the vehicle. In addition, the valves used with mechanical coolant pumps are typically only capable of allowing or preventing coolant flow to heat exchangers such as the radiator, the heater core, the engine oil heater, and the transmission oil heater. The valves are not typically capable of varying the rate of coolant flow to each of these components. Thus, the ability of these systems to balance the heating and cooling needs of the engine, the transmission, and the vehicle cabin is limited.

A vehicle thermal management system according to the present disclosure includes a mechanical coolant pump and/or a bypass line that allows the engine outlet coolant to bypass all heat exchangers in the system (e.g., a radiator, a heater core, an engine oil heater, and a transmission oil heater). Additionally or alternatively, the system includes one or more multi-position valves that control whether coolant flows to the heat exchangers and the bypass line, as well as the rate of coolant flow to the heat exchangers and the bypass line. In one example, the valves are operable to direct engine outlet coolant or engine inlet coolant to the engine oil heater and the transmission oil heater. Additionally or alternatively, the system includes an auxiliary radiator that further cools engine inlet coolant en route to the transmission oil heater.

The mechanical coolant pump is able to satisfy the cooling demands of the engine and the transmission without requiring the electrical system of the vehicle to be redesigned, which saves cost. The bypass line enables diverting flow away from the heat exchangers based on peak flow limitations and desired heat rejection. The multi-position valves enable warming the engine at a faster rate, improving vehicle fuel economy by limiting flow to the radiator, and reducing the size of the mechanical coolant pump by increasing flow to the radiator in peak flow condition. The auxiliary radiator enables operating the transmission more efficiently by reducing the viscosity of the transmission oil.

Figure 1:
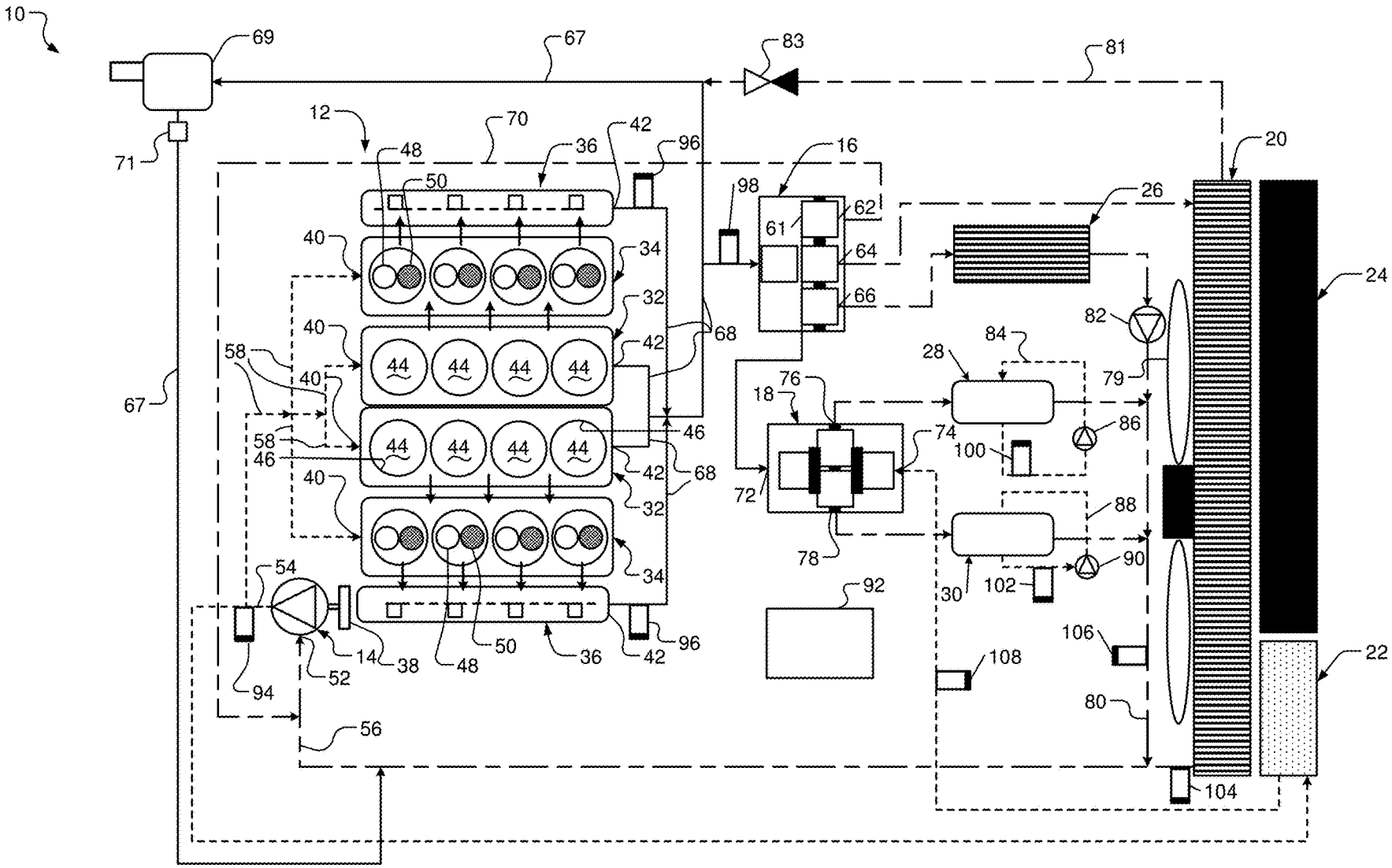
FIG. 1 is a functional block diagram of an example engine system including a main rotary valve and an oil rotary valve according to the present disclosure with the main rotary valve and the oil rotary valve adjusted to a zero flow state.

Referring now to FIG. 1, an engine system 10 includes an engine 12, a coolant pump 14, a main rotary valve (MRV) 16, an oil rotary valve (ORV) 18, a main radiator 20, an auxiliary radiator 22, a condenser 24, a heater core 26, an engine oil heat exchanger (EOH) 28, and a transmission oil heat exchanger (TOH) 30. The engine 12 includes an engine block 32, a cylinder head 34, an integrated exhaust manifold (IEM) 36, and a crankshaft 38. The engine 12 has inlets 40 that receive coolant from the coolant pump 14 and outlets 42 that discharge coolant to the MRV 16. The inlets 40 are disposed in the engine block 32 and the cylinder head 34. The outlets 42 are disposed in the engine block 32, the cylinder head 34, and the IEM 36.

The engine block 32 defines cylinders 44 having walls 46. The engine 12 further includes pistons (not shown) that are disposed within the cylinders 44 and coupled to the crankshaft 38. Air and fuel is combusted within the cylinders 44, which causes pistons to reciprocate within the cylinders 44. The reciprocal motion of the pistons causes the crankshaft 38 to rotate, which produces drive torque. The cylinder head 34 houses intake valves 48 and exhaust valves 50. Air enters the cylinders 44 through an intake manifold (not shown) and the intake valves 48 when the intake valves 48 are open. Exhaust gas exits the cylinders through the exhaust valves 50 and the IEM 36 when the exhaust valves 50 are open.

The coolant pump 14 is mechanically driven by the engine 12. The coolant pump 14 is always engaged with the engine 12 when the coolant pump 14 is assembled to the engine 12. The coolant pump 14 is coupled to the crankshaft 38. The coolant pump 14 circulates coolant through the engine 12 when the engine 12 is running. The output of the coolant pump 14 increases as the speed of the engine 12 increases. The coolant pump output decreases as the engine speed decreases.

The coolant pump 14 has an inlet 52 that receives coolant from the main radiator 20 and an outlet 54 that discharges coolant to the engine 12. The coolant pump 14 receives coolant from the main radiator 20 through a pump inlet line 56 that extends from the main radiator 20 to the inlet 52 of the coolant pump 14. The coolant pump 14 sends coolant to the engine 12 through engine inlet lines 58 that extends from the outlet 54 of the coolant pump 14 to the inlets 40 of the engine 12.

The MRV 16 receives coolant from the outlets 42 of the engine 12 and discharges coolant to the pump inlet line 56, the main radiator 20, the heater core 26, and the ORV 18. The MRV 16 is operable to control whether coolant flows to each of the pump inlet line 56, the main radiator 20, the heater core 26, and the ORV 18. For example, the MRV 16 is adjustable to a zero flow position to prevent coolant flow to the main radiator 20 and the heater core 26. In addition, the MRV 16 is operable to control the rate at which coolant flows to each of the pump inlet line 52, the main radiator 20, the heater core 26, and the ORV 18. For example, the MRV 16 is adjustable to a plurality of nonzero flow positions to allow coolant to flow to each of the pump inlet line 56, the main radiator 20, the heater core 26, and the ORV 18 at a plurality of nonzero flow rates that are different than one another.

Furthermore, the MRV 16 is operable to independently regulate coolant flow to the pump inlet line 56, the main radiator 20, the heater core 26, and the ORV 18. For example, the MRV 16 is operable to allow or prevent flow to the main radiator 20 independent of allowing or preventing flow to the heater core 26 and vice versa. In another example, the MRV 16 is operable to adjust the rate at which coolant flows to the main radiator 20 independent of adjusting the rate at which coolant flows to the heater core 26 and vice versa.

The MRV 16 has an inlet 60, a first outlet 61, a second outlet 62, a third outlet 64, a fourth outlet 66. The inlet 60 of the MRV 16 receives coolant from the outlets 42 of the engine 12 through engine outlet lines 68. The first outlet 61 of the MRV 16 discharges coolant to the ORV 18. The second outlet 62 of the MRV 16 discharges coolant to the pump inlet line 56 through a bypass line 70. The bypass line 70 allows coolant flowing therethrough to bypass the main radiator 20, the heater core 26, and the ORV 18 (and thereby bypass the EOH 28 and the TOH 30). The third outlet 64 of the MRV 16 discharges coolant to the main radiator 20. The fourth outlet 66 of the MRV 16 discharges coolant to the heater core 26. The MRV 16 controls the rate at which coolant flows to the ORV 18, the pump inlet line 52, the main radiator 20, and the heater core 26 by adjusting the opening area of the first outlet 61, the second outlet 62, the third outlet 64, and the fourth outlet 66, respectively.

When the pressure of coolant in the engine outlet lines 68 surges (changes rapidly), some of the coolant in the engine outlet lines 68 flows to the pump inlet line 56 through an engine surge line 67. A surge tank 69 and an air separator 71 are disposed in the engine surge line 67. The surge tank 69 absorbs sudden rises of pressure and quickly provides extra coolant during brief drops in pressure. The air separator 71 removes air from coolant flowing through the engine surge line 67.

The ORV 18 receives engine outlet coolant from the MRV 16, receives engine inlet coolant from the auxiliary radiator 22, and discharges engine outlet coolant or engine inlet coolant to the EOH 28 and the TOH 30. The ORV 18 is operable to control whether coolant flows to each of the EOH 28 and the TOH 30. For example, the ORV 18 is adjustable to a zero flow position to prevent coolant flow to the EOH 28 and the TOH 30. In addition, the ORV 18 is operable to control the rate at which coolant flows to each of the EOH 28 and the TOH 30. For example, the ORV 18 is adjustable to a plurality of nonzero flow positions to allow coolant to flow to each of the EOH 28 and the TOH 30 at a plurality of nonzero flow rates that are different than one another.

Furthermore, the ORV 18 is operable to independently regulate coolant flow to the EOH 28 and the TOH 30. For example, the ORV 18 is operable to allow or prevent flow to the EOH 28 independent of allowing or preventing flow to the TOH 30 and vice versa. In another example, the ORV 18 is operable to adjust the rate at which coolant flows to the EOH 28 independent of adjusting the rate at which coolant flows to the TOH 30 and vice versa.

The ORV 18 has a first inlet 72, a second inlet 74, a first outlet 76, and a second outlet 78. The inlet 72 of the ORV 18 receives engine outlet coolant from the second outlet 62 of the MRV 16. The second inlet 74 of the ORV 18 receives engine inlet coolant from the auxiliary radiator 22. The first outlet 76 of the ORV 18 discharges coolant to the EOH 28.

The second outlet 78 of the ORV 18 discharges coolant to the TOH 30. The ORV 18 controls the rate at which coolant flows to the EOH 28 and the TOH 30 by adjusting the opening area of the first outlet 76 and the second outlet 78, respectively. In various implementations, other types of multi-position valves may be used in place of the MRV 16 and/or the ORV 18.

The main radiator 20 and the auxiliary radiator 22 cool coolant flowing therethrough. The main radiator 20 includes a fan 79 that blows ambient air through the main radiator 20. The main radiator 20 receives engine outlet coolant from the third outlet 64 of the MRV 16 and discharges engine inlet coolant to the coolant pump 14 through the pump inlet line 56. The auxiliary radiator 22 receives engine inlet coolant from the engine inlet lines 58 and discharges engine inlet coolant to the second inlet 74 of the ORV 18. The engine inlet coolant discharged by the auxiliary radiator 22 is cooler than the engine inlet coolant received by the auxiliary radiator 22. The condenser 24 condenses gaseous refrigerant flowing coils in the condenser into liquid refrigerant by cooling the refrigerant. The fan 79 of the main radiator 20 blows air past the coils in the condenser 24 to cool the refrigerant. The cooled refrigerant is used to cool air within the vehicle cabin.

When the pressure of coolant in the main radiator 20 surges, some of the coolant in the main radiator 20 flows to the engine surge line 67 through a radiator surge line 81. A check valve 83 is disposed in the radiator surge line 81. The check valve 83 allows coolant flow through the radiator surge line 81 from the main radiator 20 to the engine surge line 67 while preventing coolant flow through the radiator surge line 81 from the engine surge line 67 to the main radiator 20.

The heater core 26 warms air in a vehicle cabin (not shown) by passing the air past a winding tube within the heater core 26 through which engine outlet coolant flows. In doing so, the heater core 26 cools coolant flowing therethrough. The heater core 26 receives coolant from the fourth outlet 66 of the MRV 16 and discharges coolant to the pump inlet line 56 through a heater core outlet line 80. An auxiliary pump 82 is disposed in the heater core outlet line 80. The auxiliary pump 82 is an electric pump. The auxiliary pump 82 is used to circulate coolant through the heater core 26 in order to heat the vehicle cabin during automatic engine stops.

The EOH 28 heats engine oil flowing therethrough by extracting heat from engine outlet coolant flowing through the EOH 28 and transferring the extracted heat to the engine oil flowing through the EOH 28. The EOH 28 receives engine oil from the engine 12 through an engine oil line 84 and discharges engine oil to the engine 12 through the engine oil line 84. An engine oil pump 86 disposed in the engine oil line 84 circulates engine oil through the engine oil line 84 and the EOH 28.

The TOH 30 heats transmission oil flowing therethrough by extracting heat from engine outlet coolant flowing through the TOH 30 and transferring the extracted heat to the transmission oil flowing through the TOH 30. The TOH 30 receives transmission oil from a transmission (not shown) through a transmission oil line 88 and discharges transmission oil to the transmission through the transmission oil line 88. A transmission oil pump 90 disposed in the transmission oil line 88 circulates transmission oil through the transmission oil line 88 and the EOH 28.

The engine system 10 further includes sensors and a rotary valve control module (RVCM) 92 that controls the MRV 16 and the ORV 18 based on inputs from the sensors. The sensors measure engine operating conditions and output signals to the RVCM 92 indicating the measured engine operating conditions. To signals output by the sensors are not shown to avoid confusion between the signals and the coolant lines. The sensors include an engine inlet coolant temperature sensor 94, an IEM outlet coolant temperature sensors 96, an engine outlet coolant temperature sensor 98, an engine oil temperature sensor 100, a transmission oil temperature sensor 102, a main radiator outlet temperature sensor 104, a heater core outlet temperature sensor 106, and an auxiliary radiator outlet temperature sensor 108.

The engine inlet coolant temperature sensor 94 measures the temperature of coolant flowing through the engine inlet lines 58. The IEM outlet coolant temperature sensors 96 measure the temperature of coolant discharged by the EIM 36. The engine outlet coolant temperature sensor 98 measures the temperature of coolant flowing through the engine outlet lines 68. The engine oil temperature sensor 100 measures the temperature of engine oil flowing through the engine oil line 84. The transmission oil temperature sensor 102 measures the temperature of transmission oil flowing through the transmission oil line 88. The main radiator outlet temperature sensor 104 measures the temperature of coolant discharged by the main radiator 20. The heater core outlet temperature sensor 106 measures the temperature of coolant discharged by the heater core 26, the EOH 28, and the TOH 30. The auxiliary radiator outlet temperature sensor 108 measures the temperature of coolant discharged by the auxiliary radiator 22.

The RVCM 92 controls the MRV 16 and the ORV 18 by outputting control signals to the MRV 16 and the ORV 18 indicating a target flow state (or position) of the MRV 16 and the ORV 18, respectively. The control signals are not shown to avoid confusion between the control signals and the coolant lines. The RVCM 92 adjusts the position of the MRV 16 to regulate coolant flow through the main radiator 20, the heater core 26, and the bypass line 70. The RVCM 92 regulates coolant flow through the main radiator 20 and the bypass line 70 to regulate the temperature and pressure of coolant flowing through the engine 12. The RVCM 92 regulates coolant flow through the heater core 26 to regulate the temperature of coolant flowing therethrough and thereby regulate the temperature of air within the vehicle cabin. The RVCM 92 receives the temperature of coolant flowing through the engine 12 from the engine inlet coolant temperature sensor 94, the IEM outlet coolant temperature sensors 96, and/or the engine outlet coolant temperature sensor 98. The RVCM 92 receives the temperature of coolant flowing through the heater core 26 from the heater core outlet temperature sensor 106.

The RVCM 92 adjusts the position of the ORV 18 to regulate coolant flow through the EOH 28 and the TOH 30 and to control whether the EOH 28 and the TOH 30 receive engine outlet coolant or engine inlet coolant. The RVCM 92 regulates coolant flow through the EOH 28, and controls whether the EOH 28 receives engine outlet coolant or engine inlet coolant, to regulate the temperature of coolant flowing through the EOH 28 and thereby regulate the engine oil temperature. The RVCM 92 regulates coolant flow through the TOH 30, and controls whether the TOH 30 receives engine outlet coolant or engine inlet coolant, to regulate the temperature of coolant flowing through the TOH 30 and thereby regulate the transmission oil temperature. The RVCM 92 receives the engine oil temperature from the engine oil temperature sensor 100. The RVCM 92 receives the transmission oil temperature from the transmission oil temperature sensor 102.

The RVCM 92 prioritizes the heating and cooling needs of the engine 12, transmission, and the vehicle cabin as the RVCM 92 regulates coolant flow through the main radiator 20, the auxiliary radiator 22, the heater core 26, the EOH 28, and the TOH 30. In one example, the RVCM 92 prevents coolant flow to the main radiator 20, the heater core 26, the EOH 28, and the TOH 30 to deadhead the coolant pump 14 and thereby warm up the engine 12 at a faster rate than would otherwise be possible. In another example, the RVCM 92 minimizes coolant flow through the main radiator 20 to maximize the efficiency of the engine 12 while satisfying the cooling demands of the engine 12.

Figure 2:
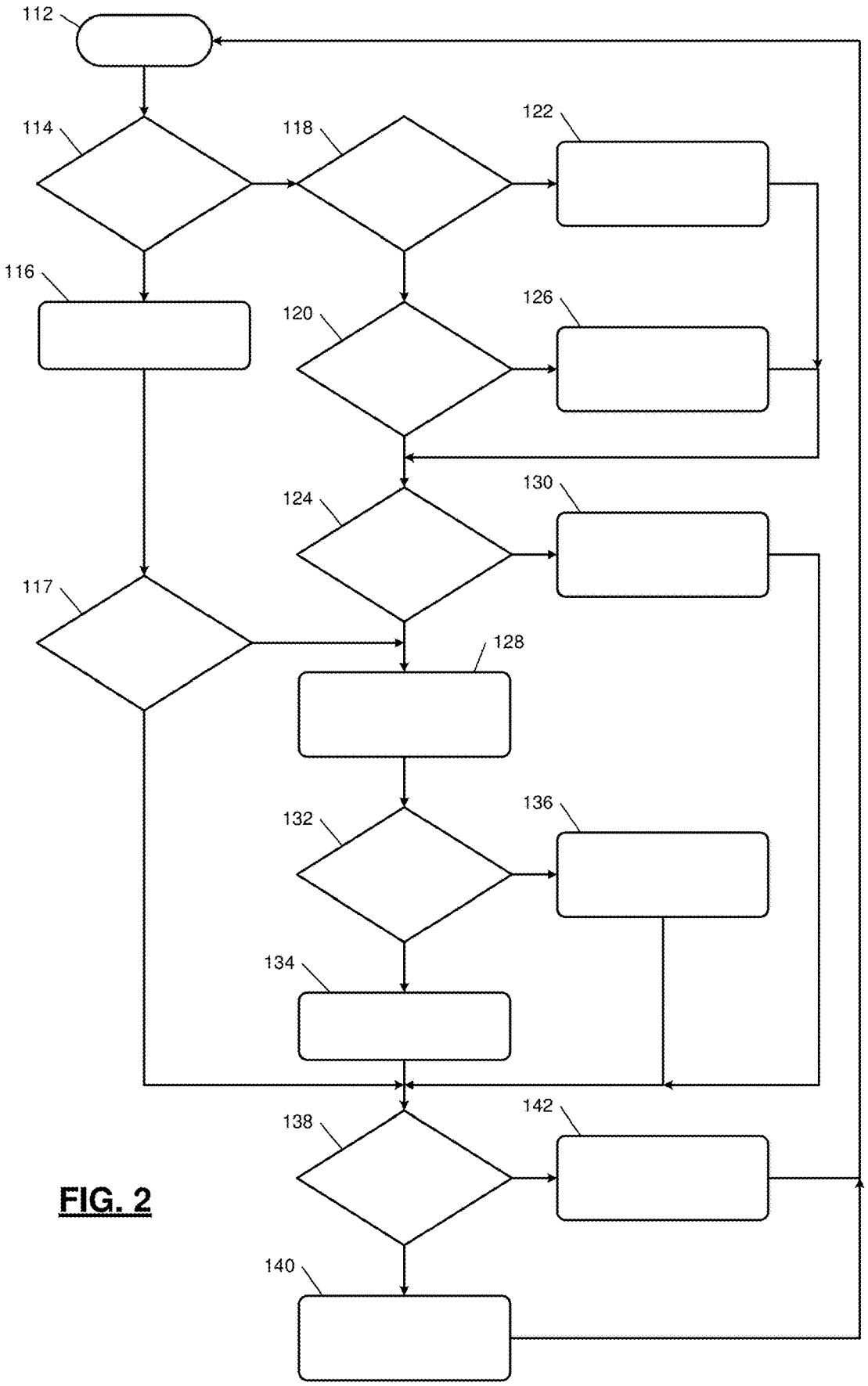
FIG. 2 is a flowchart illustrating an example method for controlling the main rotary valve and the oil rotary valve of FIG. 1 according to the present disclosure.

Referring now to FIG. 2, a method for controlling the MRV 16 and the ORV 18 begins at 112. In the description of the method set forth below, the RVCM 92 performs the steps of the method. However, other modules may perform the steps of the method. Additionally or alternatively, one or more steps of the method may be implemented apart from any module.

At 114, the RVCM 92 determines whether the engine 12 is in a cold start or warm-up phase of operation. If the engine 12 is in a cold start or warm-up phase, the method continues at 116. Otherwise, the method continues at 118. The RVCM 92 may determine that the engine 12 is in a cold start or warm-up phase when the engine coolant temperature is less than a first predetermined temperature (e.g., 40 degrees Celsius (° C.)) while the engine 12 is started. Additionally or alternatively, the RVCM 92 may determine that the engine 12 is in a cold start or warm-up phase when the temperature of a catalyst in an exhaust system (not shown) of the engine 12 is less than a second predetermined temperature (e.g., 300° C.) while the engine 12 is started. Additionally or alternatively, the RVCM 92 may determine that the engine 12 is in a cold start or warm-up phase when the engine 12 is started after the engine 12 is shut down for a first predetermined period (e.g., 12 hours). The RVCM 92 may determine when the engine 12 is started based on an input from an ignition switch.

The RVCM 92 may determine that the cold start or warm-up phase is complete when the engine coolant temperature is greater than or equal to the first predetermined temperature. Additionally or alternatively, the RVCM 92 may determine that the cold start or warm-up phase is complete when the catalyst temperature is greater than or equal to the second predetermined temperature. Additionally or alternatively, the RVCM 92 may determine that the cold start or warm-up phase is complete when the engine 12 has been running for a second predetermined period (e.g., 10 minutes).

At 116, the RVCM 92 adjusts the MRV 16 and the ORV 18 to their zero flow states (or zero flow positions). In turn, the MRV 16 prevents coolant flow to the main radiator 20 and the heater core 26, and the ORV 18 prevents coolant flow to the EOH 28 and the TOH 30. This deadheads the coolant pump 14, which causes coolant circulating through the engine 12 to warm up at a faster rate. FIG. 1 illustrates an example of coolant flow through the engine system 10 when the MRV 16 and the ORV 18 are adjusted to their zero flow states.

In the figures, coolant lines with engine inlet coolant flowing therethrough are represented by dotted lines, coolant lines with engine outlet coolant flowing therethrough are represented by solid lines, and coolant lines with no coolant flowing therethrough are represented by dashed-dotted lines. For example, in FIG. 1, engine inlet coolant is flowing through the pump inlet line 56 and the engine inlet lines 58, engine outlet coolant is flowing through the engine outlet lines 68, and no coolant is flowing through the main radiator 20, the heater core 26, the EOH 28, or the TOH 30. Thus, the pump inlet line 56 and the engine inlet lines 58 are represented by dotted lines, the engine outlet lines 68 are represented by solid lines, and the lines in which the main radiator 20, the heater core 26, the EOH 28, and the TOH 30 are disposed are represented by dashed-dotted lines.

Referring again to FIG. 2, at 117, the RVCM 92 determines whether the temperature of the cylinder walls 46 of the engine 12 is greater than or equal to a third target temperature. The third target temperature may be predetermined. If the cylinder wall temperature is greater than or equal to the third target temperature, the method continues at 128. Otherwise, the method continues at 138.

At 118, the RVCM 92 determines whether the transmission oil temperature is greater than or equal to a first target temperature (e.g., 80° C.). The first target temperature may be predetermined. If the transmission oil temperature is greater than or equal to the first target temperature, the method continues at 120. Otherwise, the method continues at 122.

At 122, the RVCM 92 adjusts the ORV 18 to a transmission warming flow state (or position). In turn, the ORV 18 allows engine outlet coolant received from the MRV 16 to flow to the TOH 30. In the transmission warming flow state, the ORV 18 may maximize the opening area of the second outlet 78 to warm up the transmission faster or restrict the opening area of the second outlet 78 to restrict flow to the TOH 30 and thereby warm up the engine 12 faster. The RVCM 92 may restrict flow to the TOH 30 by an amount that is based on the speed of the engine 12, with greater flow restriction at higher engine speeds and less flow restriction at lower engine speeds.

Figure 3:
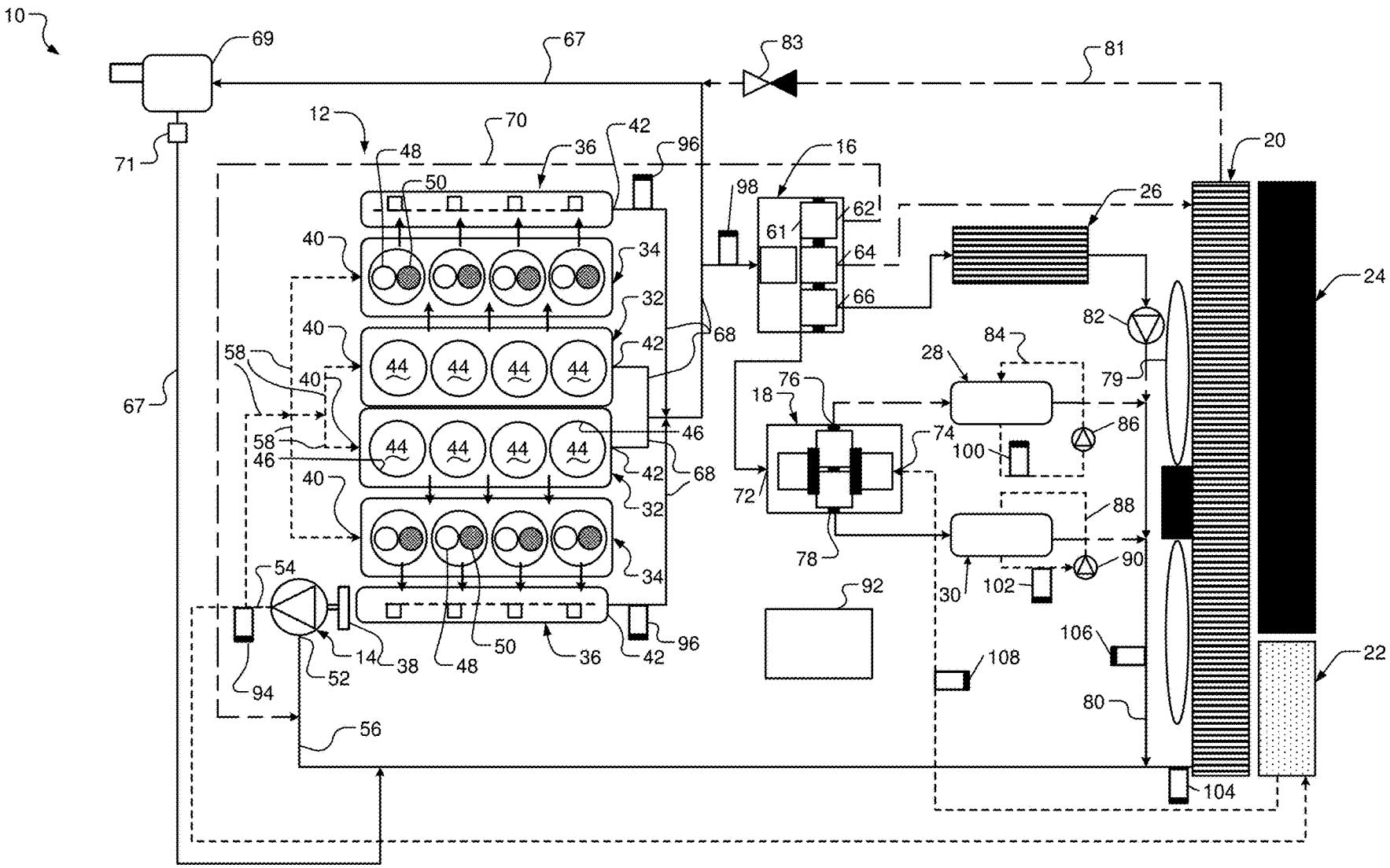
FIG. 3 is a functional block diagram of the example engine system of FIG. 1 with the main rotary valve and the oil rotary valve adjusted to a transmission oil warming flow state.

FIG. 3 illustrates an example of coolant flow through the engine system 10 when the ORV 18 is adjusted to the transmission warming flow state. In FIG. 3, the MRV 16 has been adjusted from its zero flow state to allow coolant flow to the heater core 26, and the ORV 18 has been adjusted to prevent coolant flow to the EOH 28. However, when the ORV 18 is adjusted to the transmission warming flow state, the MRV 16 may be maintained at its zero flow state and/or the ORV 18 may allow coolant flow to the EOH 28.

Referring again to FIG. 2, at 120, the RVCM 92 determines whether the engine oil temperature is greater than or equal to a second target temperature (e.g., a temperature within a range from 100° C. to 110° C.). The second target temperature may be predetermined. If the engine oil temperature is greater than or equal to the second target temperature, the method continues at 124. Otherwise, the method continues at 126.

At 126, the RVCM 92 adjusts the ORV 18 to an engine warming flow state (or position). In turn, the ORV 18 allows engine outlet coolant received from the MRV 16 to flow to the EOH 28. Coolant flows through the engine system 10 when the ORV 18 is adjusted to the engine warming flow state may be similar or identical to that shown in FIG. 3 except that, in the engine warming flow state, the ORV 18 allows engine outlet coolant to flow to the EOH 28. When the ORV 18 is in the engine warming flow state, the MRV 16 may allow or prevent coolant flow to the heater core 26, and the ORV 18 may allow or prevent coolant flow to the TOH 30.

At 124, the RVCM 92 determines whether the temperature of the cylinder walls 46 of the engine 12 is greater than or equal to the third target temperature. The third target temperature may be predetermined. If the cylinder wall temperature is greater than or equal to the third target temperature, the method continues at 128. Otherwise, the method continues at 130.

The RVCM 92 may estimate the cylinder wall temperature based on engine operating conditions. The engine operating conditions may include the speed of the engine, the engine inlet coolant temperature, the engine outlet coolant temperature, the mass flow rate of intake air drawn into the engine 12, and/or the runtime (or continuous operating period) of the engine 12. The RVCM 92 may estimate the cylinder wall temperature based on a predetermined relationship between the engine operating conditions and the cylinder wall temperature. The predetermined relationship may be embodied in a lookup table and/or an equation.

Figure 4:
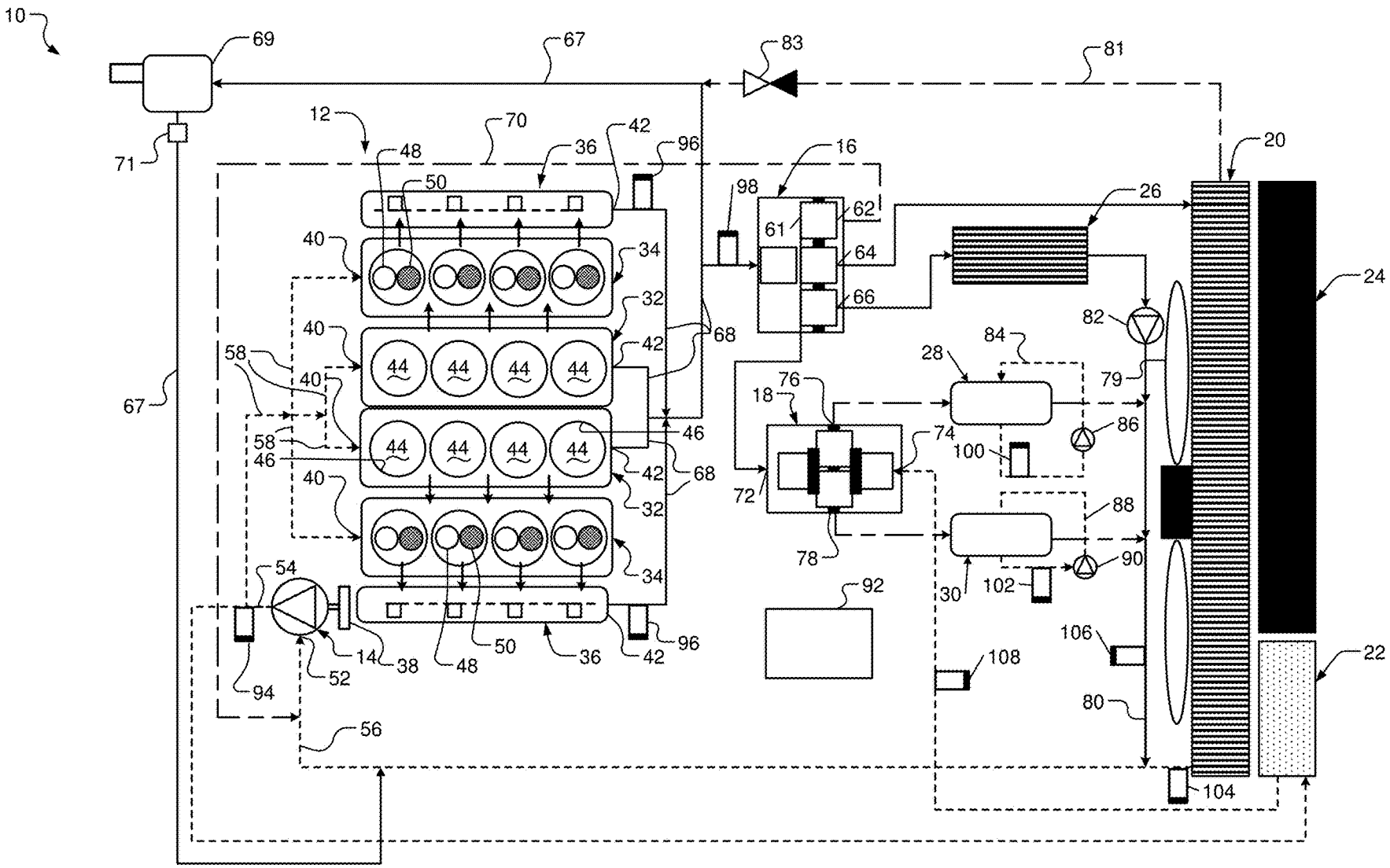
FIG. 4 is a functional block diagram of the example engine system of FIG. 1 with the main rotary valve and the oil rotary valve adjusted to a cylinder wall warming flow state.

At 130, the RVCM 92 adjusts the MRV 16 and the ORV 18 to a cylinder wall warming flow state (or position). In turn, the MRV 16 allows coolant flow to the main radiator 20 and the heater core 26, and the ORV 18 prevents coolant flow to the EOH 28 and the TOH 30. FIG. 4 illustrates an example of coolant flow through the engine system 10 when the ORV 18 is adjusted to the cylinder wall warming flow state. In FIG. 4, the MRV 16 allows coolant flow to the heater core 26 and the bypass line 70. However, the MRV 16 may prevent coolant flow to the heater core 26 and/or the bypass line 70 when the MRV is adjusted to the cylinder wall warming flow state.

Figure 5:
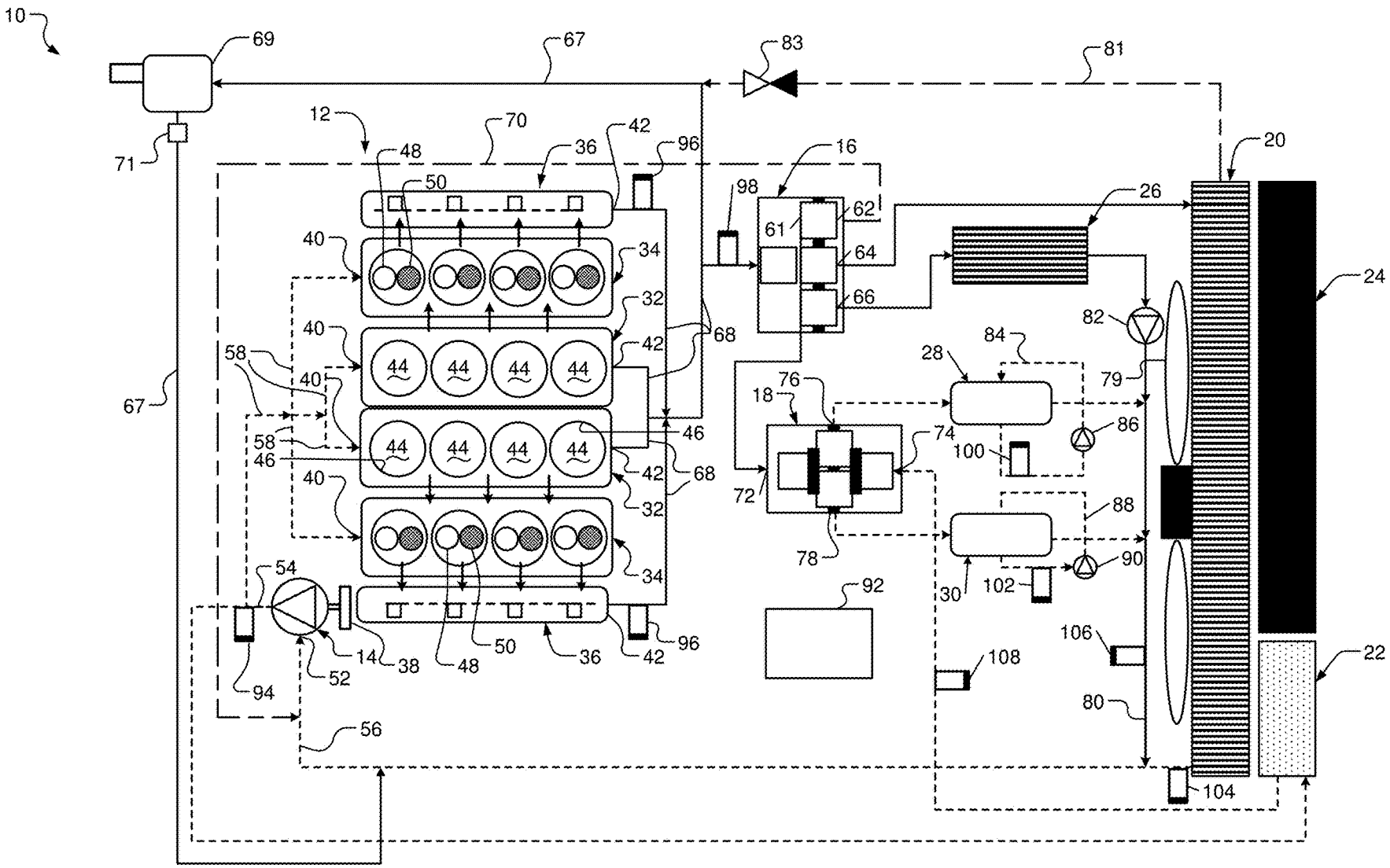
FIG. 5 is a functional block diagram of the example engine system of FIG. 1 with the main rotary valve and the oil rotary valve adjusted to a peak cooling flow state.

Referring again to FIG. 2, at 128, the RVCM 92 adjusts the MRV 16 and the ORV 18 to a peak cooling flow state (or position). In turn, the MRV 16 allows coolant to flow to the main radiator 20 and the heater core 26, and the ORV 18 allows engine inlet coolant to flow to the EOH 28 and the TOH 30. FIG. 5 illustrates an example of coolant flow through the engine system 10 when the MRV 16 and the ORV 18 are adjusted to the peak cooling flow state. In FIG. 5, the MRV 16 prevents coolant flow through the bypass line 70. However, the MRV 16 may allow coolant flow through the bypass line 70 when the MRV is adjusted to the peak cooling flow state.

Referring again to FIG. 2, at 132, the RVCM 92 determines whether speed of the engine 12 is less than a threshold speed (e.g., 3000 revolutions per minute). The threshold speed may be predetermined. The threshold speed may be selected such that engine speeds greater than or equal to the threshold speed correspond to peak coolant flow conditions. Thus, the threshold speed may be selected based on the size of the coolant pump 14. If the engine speed is less than the threshold speed, the method continues at 134. Otherwise, the method continues at 136.

At 134, the RVCM 92 adjusts the MRV 16 to a bypass closed flow state (or position). In turn, the MRV 16 prevents coolant flow to the pump inlet line 56 through the bypass line 70. Preventing coolant flow through the bypass line 70 during normal (non-peak) coolant flow conditions enables reducing the size of the coolant pump 14 by ensuring that coolant is flowing through the main radiator 20 at a sufficient rate. At 136, the RVCM 92 adjusts the MRV 16 to a bypass open flow state (or position). In turn, the MRV 16 allows coolant flow to the pump inlet line 56 through the bypass line 70, which bleeds or reduces the pressure of engine outlet coolant lines in peak coolant flow conditions.

FIG. 4 illustrates an example of coolant flow through the engine system 10 when the MRV 16 is adjusted to the bypass open flow state. As discussed above, the coolant flow illustrated in FIG. 6 also corresponds to the cylinder wall warming flow state. However, as is evident from the flow chart of FIG. 2, the bypass open flow state may also be executed in conjunction with the transmission oil warming flow sate or the engine oil warming flow state.

Referring again to FIG. 2, at 138, the RVCM 92 determines whether the heater core 26 is demanded (e.g., when heating the air within the vehicle cabin is desired). The RVCM 92 may determine that the heater core 26 is demanded when the ambient temperature is less than a predetermined temperature (e.g., 21° C.). Additionally or alternatively, the RVCM 92 may determine that the heater core 26 is demanded based on a user input from a user interface device such as a touchscreen or control knob. For example, a passenger may select a desired cabin temperature via the user interface device, and the RVCM 92 may determine that the heater core 26 is demanded when the actual cabin temperature is less than the desired cabin temperature. If the heater core 26 is demanded, the method continues at 140. Otherwise, the method continues at 142.

At 140, the RVCM 92 adjusts the MRV 16 to a heater ON flow state (or position). In turn, the MRV 16 allows coolant flow to the heater core 26. At 142, the RVCM 92 adjusts the MRV 16 to a heater OFF flow state (or position). In turn, the MRV 16 prevents coolant flow to the heater core 26. After 140 and 142, the method returns to 112. The method may be repeatedly performed when the ignition position is in an ON or START position.

Figure 6:
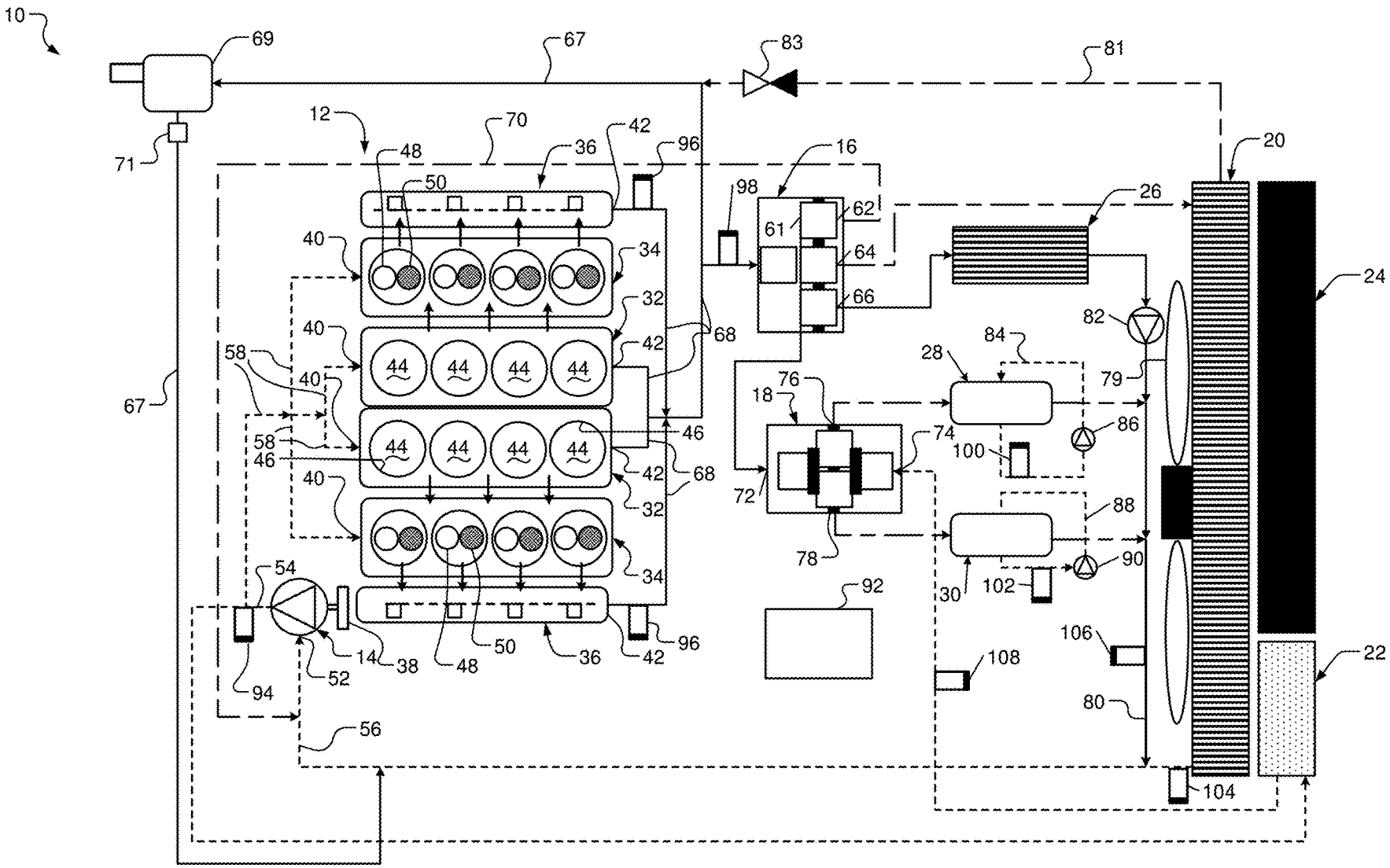
FIG. 6 is a functional block diagram of the example engine system of FIG. 1 with the main rotary valve and the oil rotary valve adjusted to a heater demand flow state.

FIG. 6 illustrates an example of coolant flow through the engine system 10 when the MRV 16 is adjusted to the heater ON flow state. The coolant flow illustrated in FIG. 6 is otherwise identical to the zero flow state illustrated in FIG. 1. However, as is evident from the flow chart of FIG. 2, the heater ON flow state may be executed in conjunction with any one of the other flow states discussed above.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A system comprising:

a coolant pump configured to be mechanically driven by an engine and to send coolant to an inlet of the engine;

a first rotary valve configured to receive coolant from an outlet of the engine and to send coolant to a first radiator and a heater core, wherein the first rotary valve is adjustable to a zero flow position to prevent coolant flow to the first radiator and the heater core and thereby increase a rate at which the engine warms coolant flowing therethrough;

a second rotary valve configured to receive coolant from the first rotary valve and to send coolant to an engine oil heater and a transmission oil heater, wherein the second rotary valve is adjustable to a zero flow position to prevent coolant flow to the engine oil heater and the transmission oil heater;

an engine inlet line extending from the coolant pump to the inlet of the engine, wherein the second rotary valve is configured to receive coolant from the engine inlet line; and a second radiator configured to:

receive coolant from the engine inlet line;

send coolant to the second rotary valve; and cool coolant flowing through the second radiator.

2. The system of claim 1 wherein the first rotary valve is adjustable to a plurality of nonzero flow positions to allow coolant to flow to each of the first radiator and the heater core at a plurality of nonzero flow rates that are different than one another.

3. The system of claim 1 wherein the first rotary valve is operable to:

regulate a rate of coolant flow to the first radiator independent of regulating a rate of coolant flow to the heater core; and regulate the rate of coolant flow to the heater core independent of regulating the rate of coolant flow to the first radiator.

4. The system of claim 1 further comprising a rotary valve control module configured to adjust the first and second rotary valves to their zero flow positions when a temperature of coolant flowing through the engine is less than a first target temperature.

5. The system of claim 4 wherein the rotary valve control module is configured to adjust the second rotary valve to send coolant to the transmission oil heater when the engine coolant temperature is greater than or equal to the first target temperature and a temperature of oil flowing through the transmission oil heater is less than a second target temperature.

6. The system of claim 4 wherein the rotary valve control module is configured to adjust the second rotary valve to send coolant to the engine oil heater when the engine coolant temperature is greater than or equal to the first target temperature and a temperature of oil flowing through the engine oil heater is less than a second target temperature.

7. A system comprising:

a coolant pump configured to be mechanically driven by an engine and to send coolant to an inlet of the engine;

a first rotary valve configured to receive coolant from an outlet of the engine and to send coolant to a first radiator and a heater core, wherein the first rotary valve is adjustable to a zero flow position to prevent coolant flow to the first radiator and the heater core and thereby increase a rate at which the engine warms coolant flowing therethrough;

a second rotary valve configured to receive coolant from the first rotary valve and to send coolant to an engine oil heater and a transmission oil heater, wherein the second rotary valve is adjustable to a zero flow position to prevent coolant flow to the engine oil heater and the transmission oil heater;

an engine inlet line extending from the coolant pump to the inlet of the engine, wherein the second rotary valve is configured to receive coolant from the engine inlet line; and a rotary valve control module configured to adjust the first and second rotary valves to their zero flow positions when a temperature of coolant flowing through the engine is less than a first target temperature, wherein, when the engine coolant temperature is greater than or equal to the first target temperature and a temperature of a cylinder wall of the engine is greater than a second target temperature, the rotary valve control module is configured to:

adjust the first rotary valve to send coolant from the outlet of the engine to the first radiator and the heater core; and adjust the second rotary valve to send coolant from the engine inlet line to the engine oil heater and the transmission oil heater.

8. The system of claim 7 further comprising a bypass line configured to receive coolant from the first rotary valve and to allow coolant flowing therethrough to bypass the first radiator and the heater core, wherein the first rotary valve is configured to send coolant to the inlet of the engine through the bypass line.

9. The system of claim 8 wherein the first rotary valve is adjustable to a plurality of nonzero flow positions to allow coolant to flow through the bypass line at a plurality of nonzero flow rates.

10. The system of claim 8 wherein the rotary valve control module is configured to adjust the first rotary valve to send coolant to the inlet of the engine through the bypass line while sending coolant to the first radiator and the heater core when the engine coolant temperature is greater than or equal to the first target temperature, the cylinder wall temperature is greater than the second target temperature, and a speed of the engine is greater than a predetermined speed.

11. The system of claim 10 wherein the rotary valve control module is configured to adjust the first rotary valve to prevent coolant flow to the engine through the bypass line when the engine coolant temperature is greater than or equal to the first target temperature, the cylinder wall temperature is greater than the second target temperature, and the engine speed is less than or equal to the predetermined speed.

12. The system of claim 8 wherein, when the engine coolant temperature is greater than or equal to the first target temperature and the cylinder wall temperature is less than or equal to the second target temperature, the rotary valve control module is configured to:

adjust the first rotary valve to send coolant from the outlet of the engine to the first radiator and the heater core and from the outlet of the engine to the inlet of the engine through the bypass line; and adjust the second rotary valve to its zero flow position to prevent coolant flow to the engine oil heater and the transmission oil heater.

13. The system of claim 8 further comprising a pump inlet line that extends from the outlet of the first radiator to the inlet of the coolant pump.

14. The system of claim 13, wherein the bypass line extends from the first rotary valve to the pump inlet line.

15. The system of claim 14 wherein the bypass line extends from the first rotary valve directly to the pump inlet line.

16. The system of claim 8 wherein the bypass line is configured to allow all coolant flowing through the system to bypass all heat exchangers in the system.

* * * * *